United States Patent [19]

Haataja et al.

[11] 4,337,710

[45] Jul. 6, 1982

[54] PALLETS MOLDED FROM MATTED WOOD FLAKES

[75] Inventors: Bruce A. Haataja, Lake Linden; Tauno B. Kilpela, Atlantic Mine; Anders E. Lund; James F. Hamilton, both of Houghton, all of Mich.

[73] Assignee: Michigan Technological University, Houghton, Mich.

[21] Appl. No.: 165,393

[22] Filed: Jul. 2, 1980

Related U.S. Application Data

[62] Division of Ser. No. 972,034, Dec. 21, 1978.

[51] Int. Cl.[3] ..... B65D 19/24

[52] U.S. Cl. ..... 108/53.3; 108/51.1

[58] Field of Search ..... 264/109, 122; 108/52.1, 108/51.1, 53.3, 57.1

[56] References Cited

U.S. PATENT DOCUMENTS

| | | | |
|---|---|---|---|
| 4,029,023 | 6/1977 | Rosewicz et al. | 108/51.1 |
| 4,061,813 | 12/1977 | Geimer et al. | 108/51.1 X |
| 4,213,928 | 7/1980 | Casselbrant | 264/120 X |

*Primary Examiner*—William E. Lyddane

*Attorney, Agent, or Firm*—Michael, Best & Friedrich

[57] ABSTRACT

An article having non-planar portions, such as a pallet having a substantially flat deck member and a plurality of hollow leg members projecting integrally from the deck member, is molded as a one-piece unit from a loosely-felted, layered mat formed from a mixture of a resinous particle board binder and flake-like wood particles. The wood flakes have an average length of about $1\frac{1}{4}$ to about 6 inches, preferably about 2 to about 3 inches, an average thickness of about 0.005 to about 0.075 inch, preferably about 0.015 to about 0.025 inch, and an average width of 3 inches or less and no greater than the average length. Each layer of wood flakes in the mat lie substantially flat on a plane generally parallel to the major plane thereof and are randomly oriented to each other. The mat is placed between the male and female dies of a mold or press and compressed therein to substantially the desired shape under temperature and pressure conditions sufficient to bond the flakes together.

8 Claims, 7 Drawing Figures

PALLETS MOLDED FROM MATTED WOOD FLAKES

CROSS REFERENCE TO RELATED APPLICATIONS

This is a division of application Ser. No. 972,034 filed Dec. 21, 1978.

BACKGROUND OF THE INVENTION

This invention relates to articles molded from flake-like wood particles and, more particularly, to such articles having non-planar portions, such as material handling pallets and the like.

Considerable effort has been devoted to developing techniques for molding articles including non-planar portions from inexpensive residue and surplus woods. One area of particular interest for utilizing such woods is in the production of material handling pallets having at least the same strength and durability and other desirable characteristics of standard pallets constructed from lumber.

It is well known to manufacture flat or substantially flat structural boards or so-called particle board from comminuted wood by mixing the wood particles with a suitable resinous binder, such as a synthetic thermosetting resin, forming the mixture into a multilayered mat and then compressing the mat between heated platens to set the binder and bond the wood particles together. This type process is exemplified in U.S. Pat. Nos. 3,164,511, 3,391,233 and 3,940,230.

Molding of pallets and other articles including non-planar portions presents problems of little or no concern in the manufacture of flat or substantially flat particle board. For instance, one difficulty involved in molding pallets is the necessity to pull or draw a plurality of hollow legs having acceptable crushing strengths from a substantially flat mat of wood particles without adversely affecting the strength of the deck member or the legs. Consequently, the above type process for manufacturing particle board heretofore has not been employed to manufacture pallets or other similar articles from wood particles.

In one prior art method for molding pallets from wood particles, exemplified by U.S. Pat. Nos. 3,104,085, 3,359,929 and 3,611,952, wood fibers are made into a pulp slurry which typically also contains a resinous or other suitable binder. The slurry is introduced into a mold wherein most of the water is removed by compressing, application of a vacuum or positive pressure, etc. The wet, molded pallet is transferred to a heated mold and dried under elevated pressure and temperature conditions to expedite removal of water, and to cure the binder if one is included in the slurry. If a binder is not included in the slurry, the dried pallet usually is dipped into a resin containing solution for strengthening and water proofing. This prior art method involves several expensive processing steps and the pallets produced thereby do not have acceptable strength characteristics or durability for many applications.

In another prior art method for molding pallets from wood particles, promoted in the United States under the trademark "WERZALIT" and exemplified by U.S. Pat. Nos. 3,146,285 and 3,354,248, a mixture of finely comminuted wood particles and a heat curable, resinous binder is introduced into a cold press to form a preform having nearly the final size and shape of the pallet, with partial or no curing of the binder. The preform is transferred to a heated press or mold wherein it is compressed to the final size and shape at an elevated temperature to completely cure the binder. This method is relatively expensive because of the degree to which the starting material must be comminuted, the amount of binder required to bond the relatively small wood particles together, the capital investment for the different presses, and the operating costs associated with the numerous processing steps.

SUMMARY OF THE INVENTION

A principal object of the invention is to provide an article, such as a material handling pallet, having a main body and non-planar portions displaced from the major plane of the body, the main body and non-planar portions being molded as a one-piece unit from low cost woods.

Another object of the invention is to provide a pallet molded from low cost woods and having strength and handling characteristics at least comparable to standard pallets made from stick lumber.

A further object of the invention is to provide a simplified method for molding such pallets and other articles having non-planar portions from low cost wood particles.

A still further object of the invention is to provide such a method which does not require formation of a preform prior to molding to final dimensions and does not require finely comminuted wood particles.

Other objects, aspects and advantages of the invention will become apparent to those skilled in the art upon reviewing the following detailed description, the drawings and the appended claims.

The pallet provided by the invention includes a deck member having a major plane and a plurality of hollow leg members projecting integrally from the deck member, each leg member having a bottom wall spaced from the deck member and side walls inclining outwardly from the bottom wall toward the deck member. The deck and leg members are molded as a one-piece unit from a layered mixture of a resinous particle board binder, such as thermosetting resin, an organic polyisocyanate, or a mixture thereof, and flake-like wood particles having an average length of about $1\frac{1}{4}$ to about 6 inches, an average thickness of about 0.005 to about 0.075 inch, and an average width of about 3 inches or less and no greater than the average length. Each layer of wood flakes forming at least the deck member lies substantially flat in a plane generally parallel to the major plane of the deck member and are randomly oriented to each other in that plane.

The sidewalls of the leg members can extend at an angle of about 78° or less relative to the major plane of the deck member and can have an average thickness which is about 70 to 110%, preferably about 80–85%, of the average thickness of the deck member.

The pallet contains about 2 to about 15 weight % of the binder, and optionally about 0.5 to about 2 weight %, based on the dry weight of the wood flakes, of a wax to provide water proof protection. Organic polyisocyanates, either alone and in combination with urea-formaldehyde, are the preferred binder.

In a preferred method, the wood flakes are admixed with a resinous particle board binder, the resulting mixture or furnish is deposited as a loosed-felted, layered mat on one part of an open mold or press including two separable parts defining a mold chamber having the shape of the pallet, the mold is closed, and pressure is applied to the mat to compress it into substantially the desired shape and size of the pallet and to bond the wood flakes together.

In one embodiment, a mat of substantially uniform thickness is formed outside the mold in a manner whereby the flakes in each layer lie substantially flat and are randomly oriented and this mat is placed between the male and female dies of the mold.

In another embodiment, a mat is formed outside the mold as described in the previous paragraph and mounds of furnish is added on top of the mat at locations corresponding to the leg-forming cavities of the female die.

In a further embodiment, the leg-forming cavities of the female die are first substantially filled with furnish and the mat is then placed between the male and female dies.

In a still further embodiment, the mat is formed directly on the female die or a remote caul which has a shape conforming with the female die and is subsequently placed over the female die. This technique and those described in the two preceding paragraphs are particularly advantageous for molding leg members having a length or depth up to about 5 inches or more.

DESCRIPTION OF THE PREFERRED EMBODIMENTS

The invention relates broadly to articles, particularly support members, including a main body having a major plane and non-planar portions displaced from that major plane, both molded as a one-piece unit from wood flakes. The invention is particularly adaptable to material handling pallets and will be described in connection therewith.

Figure 1:
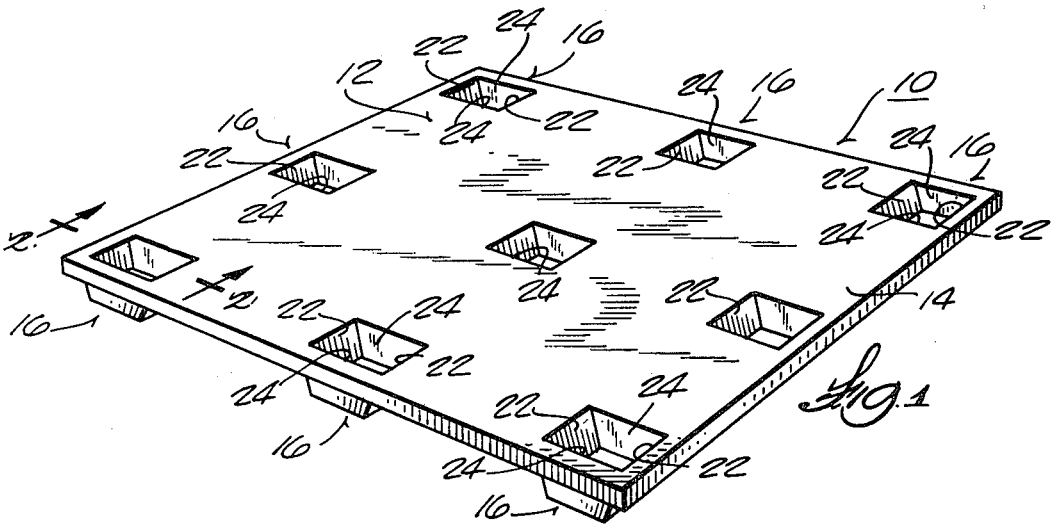
FIG. 1 is a perspective view of a pallet incorporating various features of the invention.
Figure 2:
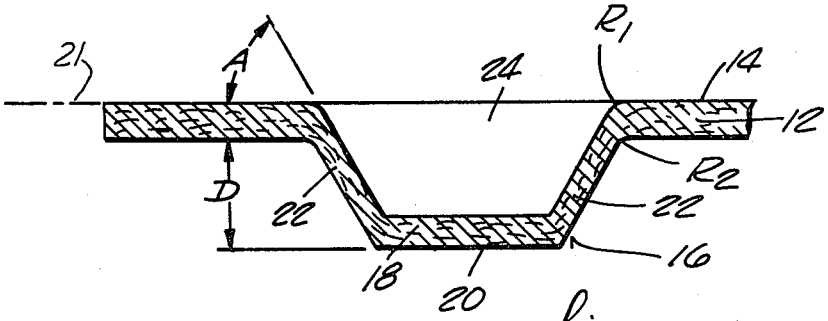
FIG. 2 is a sectional view taken generally along line 2—2 in FIG. 1.

Illustrated in FIGS. 1 and 2 is pallet 10 including a generally flat, rectangular deck member 12 having a substantially uniform wall thickness and a flat upper surface 14 which serves as a supporting plane. Projecting downwardly from the deck member 12 is a plurality (e.g. 9) of hollow leg members 16 adapted to serve as supporting pads for the pallet. In the specific construction illustrated, each of the leg members 16 (FIG. 2) includes a bottom wall 18 having a flat bottom surface 20 and two opposed pairs of flat side walls 22 and 24. The bottom surface 20 of the bottom wall 18 is spaced from the underneath surface of the deck member 12 a sufficient distance to permit entry of the tines of a fork lift beneath the deck member.

The deck member 12 and leg members 16 are molded as a one-piece unit from a mixture of a suitable resinous particle board binder and flake-like wood particles as described below. The side walls 22 and 24 of the leg members 16 are inclined or tapered to facilitate molding and to also permit nesting of several pallets into a compact stack so as to minimize the space required for shipment and storage. In the specific construction illustrated, the side walls 22 and 24 are substantially flat and the leg members 16 have the general form of an inverted, truncated hollow pyramid. If desired, the leg members 16 can be formed with other suitable cross-sectional shapes, e.g., in the form of an inverted, truncated hollow cone.

Figure 3:
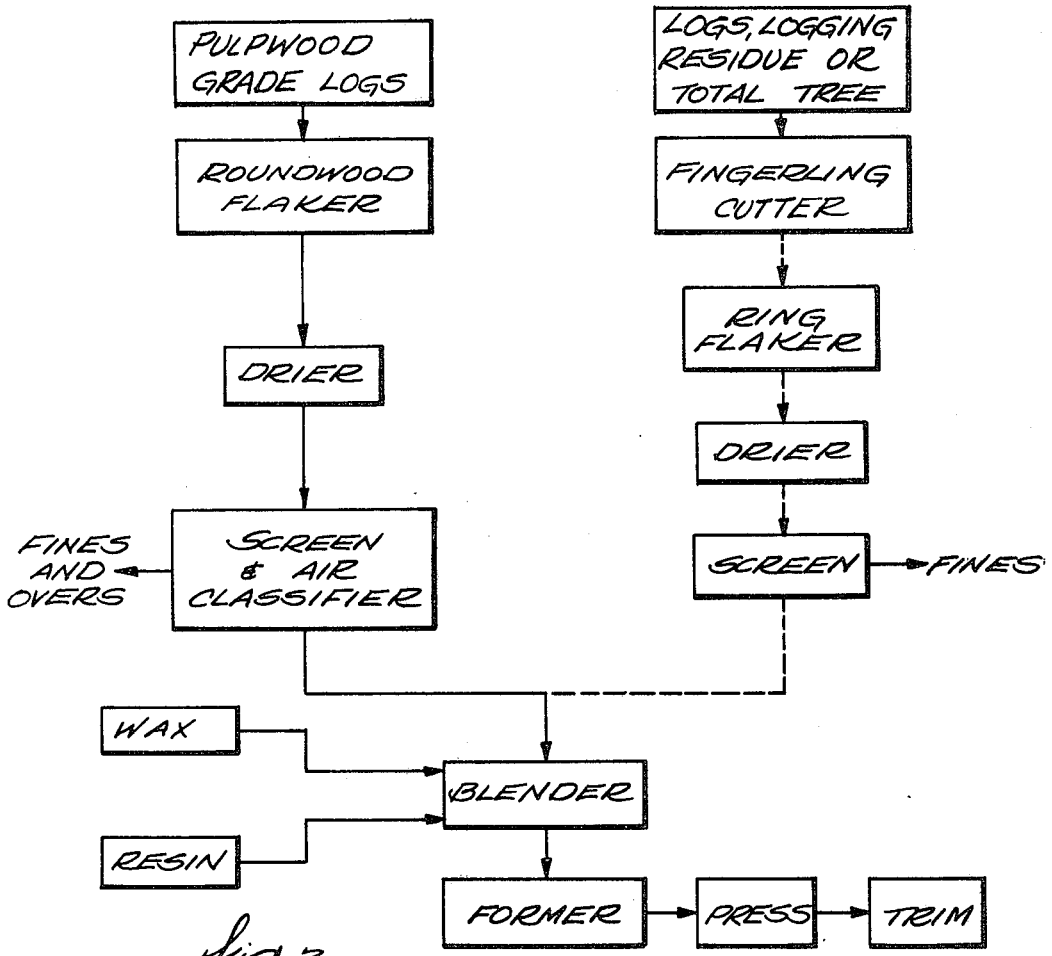
FIG. 3 is a schematic flow diagram illustrating the various steps of a preferred process for molding pallets of the invention from residue and surplus woods.

FIG. 3 diagrammatically illustrates the various steps of the process of the invention for manufacturing the pallet 10 from inexpensive residue and surplus woods. The process broadly includes the steps of comminuting small logs, branches or rough pulpwood into flake-like particles, drying the wood flakes to a predetermined moisture content, classifying the dried flakes to obtain wood particles having a predetermined size, blending predetermined quantities of a suitable resinous particle board binder, and optionally a liquid wax composition, with the dried and sized flakes, forming the resultant mixture of binder, wax and wood flakes or furnish into a loosely-felted, layered mat (single or multi-layers), placing the mat in an open mold or press including separable male and female dies defining a mold chamber having the desired shape of the pallet, closing the mold and applying sufficient pressure to mat to compress it into substantially the desired shape and size of the pallet, removing the molded pallet from the press, and trimming the peripheral edges of the pallet with a power saw or the like to the desired final dimensions.

The wood flakes used can be prepared from various species of suitable hardwoods and softwoods used in the manufacture of particle board. Representative examples of suitable woods include aspen, maple, oak, elm, balsam fir, pine, cedar, spruce, locust, beech, birch and mixtures thereof.

Suitable wood flakes can be prepared by various conventional techniques. In the specific process illustrated, the wood flakes are prepared by one of two different techniques. In the technique illustrated in the upper left hand portion of FIG. 3, pulpwood grade logs, or so-called roundwood, are converted into flakes in one operation with a conventional roundwood flaker. In the technique illustrated in the upper right hand portion of FIG. 3, logs, logging residue or the total tree are first cut into fingerlings in the order of 2–6 inches long with a conventional device, such as the helical comminuting shear disclosed in U.S. Pat. No. 4,053,004, and the fingerlings are flaked in a conventional ring-type flaker.

Roundwood flakes generally are higher quality and produce stronger pallets because the lengths and thickness can be more accurately controlled. Also, roundwood flakes tend to be somewhat flatter which facilitates more efficient blending and the logs can be debarked prior to flaking which reduces the amount of less desirable fines produced during flaking and handling. Acceptable flakes can be prepared by ring flaking fingerlings and this technique is more readily adaptable to accept wood in poorer form, thereby permitting more complete utilization of certain types of residue and surplus woods.

Irrespective of the particular technique employed for preparing the flakes, the size distribution of the flakes is quite important, particularly the length and thickness. The wood flakes should have an average length of about $1\frac{1}{4}$ inch to about 6 inches and an average thickness of about 0.005 to about 0.075. In any given batch, some of the flakes can be shorter than $1\frac{1}{4}$ inch and some can be longer than 6 inches so long as the overall average length is within the above range. The same is true for the thickness.

The presence of major quantities of flakes having a length shorter than about $1\frac{1}{4}$ inch tends to cause the mat to pull apart as the leg members are being drawn therefrom during the molding step. This undesirable condition is particularly prevalent at the corner junctures of the leg members and the deck member as described in more detail below. The presence of some fines in the mat produces a smoother surface and, thus, may be desirable for some applications so long as the majority of the wood flakes, preferably at least 75%, is longer than $1\frac{1}{8}$ inch and the overall average length is at least $1\frac{1}{4}$ inch.

Substantial quantities of flakes longer than about 6 inches tend to cause interleaving or felting of the flakes during handling prior to formation of the mat and can complicate drawing of the leg members. For example, such interleaving can prevent adequate coating of the flakes with the binder during the blending step with a resultant inadequate bonding of the flakes during molding. The average length of the wood flakes preferably is about 2 to about 3 inches.

Substantial quantities of flakes having a thickness of less than about 0.005 should be avoided because excessive amounts of binder are required to obtain adequate bonding. On the other hand, flakes having a thickness greater than about 0.075 inch are relatively stiff and tend to overlie each other at some incline when formed into the mat. Consequently, excessively high mold pressures are required to compress the flakes into the desired intimate contact with each other. For flakes having a thickness falling within the above range, thinner ones produce a smoother surface while thicker ones require less binder. These two factors are balanced against each other for selecting the best average thickness for any particular application. The average thickness of the flakes preferably is about 0.015 to about 0.25 inch, most preferably about 0.020 inch.

The width of the flakes is less important. The flakes should be wide enough to insure that they lie substantially flat when felted during mat formation. The average width generally should be about 3 inches or less and no greater than the average length. For best results, the majority of the flakes should have a width of about 1/16 inch to about 3 inches.

The thickness of the flakes can be controlled primarily by the blade setting on the flaker. The length and width of the flakes are also controlled to a large degree by the flaking operation. For example, when the flakes are being prepared by ring flaking fingerlings, the maximum lengths are generally set by the length of the fingerlings. Other factors, such as the moisture content of the wood and the amount of bark on the wood affect the amount of fines produced during flaking. Dry wood is more brittle and tends to produce more fines. Bark has a tendency to more readily break down into fines during flaking and subsequent handling than wood.

While the flake size can be controlled to a large degree during the flaking operation as described above, it usually is necessary to use some sort of classification in order to remove undesired particles, both undersized and oversized, and thereby ensure the average length, thickness and width of the flakes are within the desired ranges. When roundwood flaking is used, both screen and air classification usually is required to adequately remove both the undersize and oversize particles, whereas fingerling flakes usually can be properly sized with only screen classification.

Flakes from some green woods can contain up to 90% moisture. The moisture content of the mat must be substantially less for molding as discussed below. Also, wet flakes tend to stick together and complicate classification and handling prior to blending. Accordingly, the flakes are preferably dried prior to classification in a conventional type drier, such as an tunnel drier, to the moisture content desired for the blending step. The moisture content to which the flakes are dried usually is in the order of about 6 weight % or less, preferably about 2 to about 5 weight %, based on the dry weight of the flakes. If desired, the flakes can be dried to a moisture content in the order of 10 to 25 weight % prior to classification and then dried to the desired moisture content for blending after classification. This two-step drying may reduce the overall energy requirements for drying flakes prepared from green woods in a manner producing substantial quantities of particles which must be removed during classification and, thus, need not be as thoroughly dried.

A known amount of the dried, classified flakes is introduced into a conventional blender, such as a paddle-type batch blender, wherein predetermined amounts of a resinous particle binder, and optionally a wax and other additives, is applied to the flakes as they are tumbled or agitated in the blender. Suitable binders include those used in the manufacture of particle board and similar pressed fibrous products and, thus, are broadly referred to herein as "resinous particle board binders". Representative examples of suitable binders include thermosetting resins such as phenol-formaldehyde, resorcinol-formaldehyde, melamine-formaldehyde, urea-formaldehyde, urea-furfural and condensed furfuryl alcohol resins, and organic polyisocyanates, either alone or combined with urea- or melamine-formaldehyde resins. Particularly suitable polyisocyanates are those containing at least two active isocyanate groups per molecule, including diphenylmethane diisocyanates, m- and p-phenylene diisocyanates, chlorophenylene diisocyanates, toluene di- and triisocyanates, triphenylmethene triisocyanates, diphenylether-2,4,4'-triisocyanate and polyphenylpolyisocyanates, particularly diphenylmethane-4,4'-diisocyanate.

The particular type binder used depends primarily upon the intended use for the pallet. For instance, pallets employing urea-formaldehyde resins have sufficient moisture durability for many uses which involve minimal exposure to moisture, but generally cannot withstand extended outdoor exposure and reusability is quite limited. Phenol-formaldehyde and melamine-formaldehyde resins provide good moisture resistance but require substantially longer cure times. Polyisocyanates, even in lesser amounts, provide greater strengths and moisture resistance than the urea- or phenol-formaldehyde resins and the resultant pallets can be reused for an extended number of cycles. Polyisocyanates cure in about the same time as urea-formaldehyde resins. However, polyisocyanates are more expensive and require the use of a mold release agent because of their tendency to stick to metal parts. These factors are balanced against each other when selecting the specific binder to be used.

A binder system including both a urea-formaldehyde resin and a polyisocyanate, at a solids weight ratio of about 4:1 to about 1:1, is advantageous for many applications because, although less costly than polyisocyanate alone, it provides strength characteristics and moisture resistance which is superior to those obtainable from either urea- or phenol-formaldehyde resins alone and the pallets are reusable.

The amount of binder added to the flakes during the blending step depends primarily upon the specific binder used, size, moisture content and type of the flakes, and the desired characteristics of the pallet. Generally, the amount of binder added to the flakes is about 2 to about 15 weight %, preferably about 4 to about 10 weight %, as solids based on the dry weight of the flakes. When a polyisocyanate is used alone or in combination with a urea-formaldehyde resin, the amounts can be more toward the lower ends of these ranges.

The binder can be admixed with the flakes in either dry or liquid form. To maximize coverage of the flakes, the binder preferably is applied by spraying droplets of the binder in liquid form onto the flakes as they are being tumbled or agitated in the blender. When polyisocyanates are used, a conventional mold release agent preferably is applied to the die or to the surfaces of the formed mat prior to pressing. To improve water resistance of the pallet, a conventional liquid wax emulsion preferably is also sprayed onto the flakes during the blending step. The amount of wax added generally is about 0.5 to about 2 weight %, as solids based on the dry weight of the flakes. Other additives, such as a coloring agent fire retardant, insecticide, fungicide and the like may also be added to the flakes during the blending step. The binder, wax and other additives, can be added separately in any sequence or in combined form.

The moistened mixture of binder, wax and flakes or furnish from the blending step is formed into a loosely-felted, single or multi-layered mat which is compressed into a pallet. The moisture content of the flakes should be controlled within certain limits so as to obtain adequate coating by the binder during the blending step and to enhance binder curing and deformation of the flakes during molding.

The presence of moisture in the flakes facilitates their bending to make intimate contract with each other and to form the leg members and enhances uniform heat transfer throughout the mat during the molding step, thereby ensuring uniform curing. However, excessive amounts of water tends to degrade some binders, particularly urea-formaldehyde resins, and generates steam which can cause blisters. On the other hand, if the flakes are too dry, they tend to absorb excessive amounts of the binder, leaving an insufficient amount on the surface to obtain good bonding and the surfaces tend to case harden which inhibits the desired chemical reaction between the binder and cellulose in the wood. This latter condition is particularly true for polyisocyanate binders.

Generally, the moisture content of the furnish after completion of blending, including the original moisture content of the flakes and the moisture added during blending with the binder, wax and other additives, should be about 5 to about 25 weight %, preferably about 8 to about 12 weight %. Generally, higher moisture contents within these ranges can be used for polyisocyanate binders because they do not produce condensation products upon reacting with cellulose in the wood.

The furnish is formed into a generally flat, loosely-felted, mat, preferably as multiple layers, having a rectangular shape generally corresponding to the outer dimensions of the pallet. A conventional dispensing system, similar to those disclosed in U.S. Pat. Nos. 3,391,223 and 3,824,058, can be used to form the mat. Generally, such a dispensing system includes a plate-like carriage carried on an endless belt or conveyor and one or more (e.g., 3) hoppers spaced along the belt in the direction of travel for receiving the furnish. When a multi-layered mat is formed in accordance with a preferred embodiment, a plurality of hoppers usually are used with each having a dispensing or forming head extending across the width of the carriage for successively depositing a separate layer of the furnish as the carriage is moved beneath the forming heads.

In order to produce pallets having the desired strength characteristics, the mat should have a substantially uniform thickness and the flakes should lie substantially flat in a horizontal plane parallel to the surface of the carriage and be randomly oriented relative to each other in that plane. The uniformity of the mat thickness can be controlled by depositing two or more layers of the furnish on the carriage and metering the flow of furnish from the forming heads.

The desired random orientation of the flakes can be enhanced by spacing the forming heads above the carriage so the flakes must drop about 1 to about 3 feet en route to the carriage. As the flat flakes fall from that height, they tend to spiral downwardly and land generally flat in a random pattern. Wider flakes within the range discussed above enhances this action. A scalper or similar device spaced above the carriage can be used to ensure uniform thickness or depth of the mat; however, such means usually tends to align the top layer of flakes, i.e., eliminate the desired random orientation. Accordingly, the thickness of the mat preferably is controlled by closely metering the flow of furnish from the forming heads.

The mat thickness used will vary depending upon such factors as the size and shape of the wood flakes, the particular technique used for forming the mat, the desired thickness and density of the pallet deck and leg members, the configuration of the pallet (particularly the size and shape of the leg members), and the molding pressure to be used. For example, if the pallet is to have a ½-inch thick deck member and a density of 45 pounds per cubic foot, the mat usually will be about 3 inches thick when roundwood flakes are used and about 4 inches thick when flakes prepared by ring flaking fingerlings are used. Of all these variables, the final density of the pallet is the primary factor for determining the mat thickness.

Figure 4:
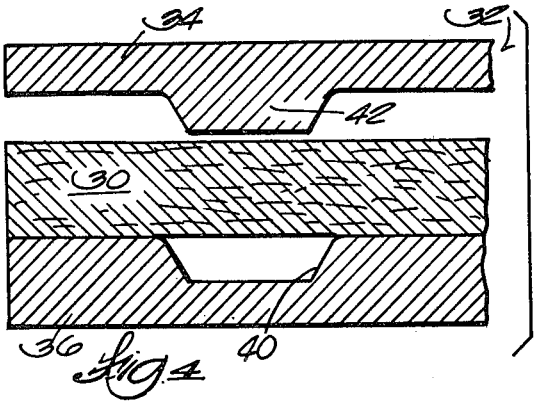
FIGS. 4–7 are simplified, schematic side views of the mold or press, illustrating various techniques for depositing a mat of the wood flakes on the female die prior to closing the mold.

Referring to FIG. 4, the mat 30 is compressed in a heated press or mold 32 including a movable male die 34 and a stationary female die 36 which cooperate to define a mold chamber having the shape of the pallet. The female die 36 includes a plurality of cavities 40 (one shown), each defining the exterior of a leg member 16, and the male die 34 includes a plurality of corresponding protruberances 42 (one shown), each defining the interior of a leg member 16.

The mat 30 is removed from the forming carriage and deposited on the female die 36 as illustrated. When the male die 34 is closed, portions of the mat 30 are drawn or pulled down into the female die cavities 40 to form the leg members 16 as contrasted to the material flowing into the mold cavities as is the case with plastic materials and finely comminuted fibrous molding compositions. Thus, the corner junctures between the leg member 16 and the deck member 12 are particularly vulnerable to structural weakening resulting from a tendency for the flakes to be pulled apart during the molding operation.

The process of the invention minimizes this tendency, in a large part, by using wood flakes having dimensions within the ranges noted above and forming the mat 30 so that the layers of wood flakes lie substantially flat and are randomly oriented. Instead of pulling apart at the corner junctures, a number of the flakes more or less are bent or deformed around the corners and thereby provide joints having substantial structural integrity.

Because of this drawing or pulling action on the mat during molding, there are some practical limitations for the pallet configuration. Referring to FIG. 2, the slope of the side walls 22 and 24 with respect to the major horizontal plane of the deck member 16, designated by angle A, should not exceed about 78°. If relatively tight corners are desired between the bottom of the deck member 12 and the leg member 16, the outer radii, designated as $R_1$, should be substantially larger than the inner radii, designated as $R_2$. Larger leg members (e.g., 7 inches×9 inches) generally are easier to mold than smaller leg members (e.g., 5 inch diameter) when the side walls have the same slope. As a general rule, the slope and depth is less for smaller leg members. The leg member side walls 22 and 24 generally are provided with a thickness which is 70 to 110%, preferably about 80–85%, of the deck member thickness. The bottom wall thickness can be about 60–100% the deck member thickness.

The leg members should not be closer than about 6 inches from each other. Even at this distance, an additional quantity of the flakes may be required to compensate for those pulled or drawn down into the female die cavities during the molding operation, particularly when deeper or longer leg members are formed. For example, when a mat formed outside the mold and placed between the male and female dies as illustrated in FIG. 4 is used in the production of a 40 inch×48 inch pallet having 9 legs, leg members having a depth (designated by dimension D in FIG. 2) up to about 1¾ inches can be conveniently drawn from such a mat.

Figure 5:
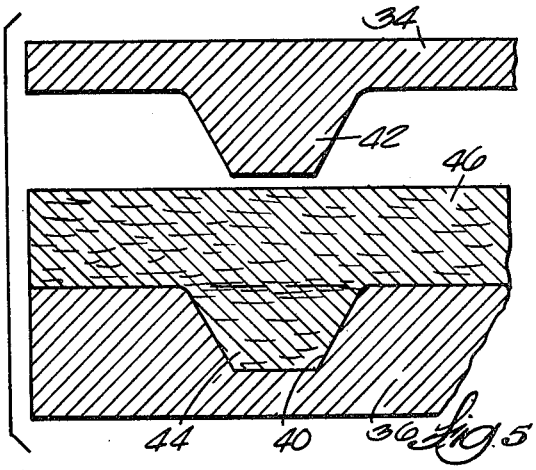
Figure 6:
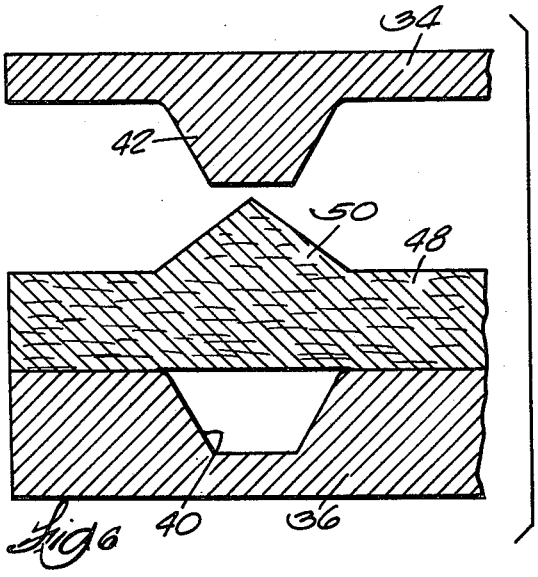
Figure 7:
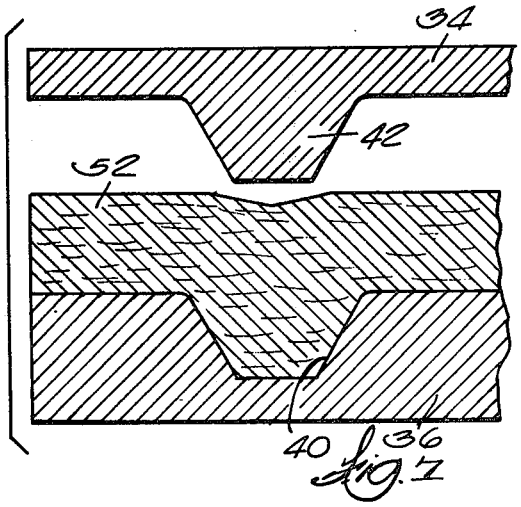

FIGS. 5–7 illustrate alternate techniques for depositing the flakes in the mold so as to permit drawing of longer or deeper leg members. In the technique illustrated in FIG. 5, the cavities 40 of the female die 36 are first substantially filled with furnish 44 and a loosely-felted mat 46, having a substantially uniform thickness and formed outside the mold similar to mat 30 in FIG. 4, is deposited on the female die 36 over the filled cavities prior to closing the mold.

In the technique illustrated in FIG. 6, a loosely-felted mat 48 of substantially uniform thickness is formed outside the mold, similar to the mat 30 in FIG. 4, and mounds 50 of additional furnish required for a deep draw are deposited on top of the mat 48 at locations corresponding to the locations of the female die cavities 40 prior to placing the mat 48 in the mold. The technique illustrated in FIGS. 5 and 6 have been successfully employed to form pallets having leg members of depths up to 5 inches or more and sidewall slopes between 56° and 77°.

In the technique illustrated in FIG. 7, the mat 52 is loosely felted directly onto the female die 36 by passing the female die 36 beneath the forming heads. (not shown) Alternately, the mat can be deposited on a remote caul or or pan which conforms to the female die and is subsequently placed over the female die. The additional furnish required for a deep draw is provided by the tendency for the cavities 40 of the female die 36 or the caul to absorb extra furnish during the felting operation.

Molding temperatures, pressures and times vary widely depending upon the thickness and desired density of the pallet, size and type of wood flakes, moisture content of the flakes, and the type of binder used. The molding temperature used is sufficient to at least partially cure the binder and expel water from the mat within a reasonable time period and without charring the wood. Generally, a molding temperature ranging from ambient up to about 450° F. can be used. Temperatures above about 450° F. can cause charring of the wood. When a binder system including a urea-formaldehyde resin and a polyisocyanate is used, a molding temperature of about 250° to about 375° F. is preferred while a molding temperature of about 300° to about 425° F. is preferred for phenol-formaldehyde resin binders.

The molding pressure used should be sufficient to press the wood flakes into intimate contact with each other without crushing them to the point where lignin starts to exude, causing a breakdown in the fibers with a resultant degradation in structural integrity. The molding pressure on the net die area typically is about 300 to about 700 psi.

The time of the molding or press cycle is sufficient to at least partially cure the binder to a point where the pallet has adequate structural integrity for handling. The press cycle typically is about 2 to about 10 minutes; however, shorter or longer times can be used when pressure-curing binders are employed to when more complete curing of certain thermosetting binders is desired.

After the pallet is removed from the mold, the peripheral edges are trimmed to the desired final dimensions, e.g., 40 inches×48 inches. The molding apparatus can include means which provides built-in trimming during pressing. A typical pallet will contain about 9 weight % resin, about 1 weight % wax and about 92 weight % wood when a thermosetting resin type binder is used. The resin content typically is about 5 weight % when a polyisocyanate resin is used and about 7 weight % when the binder is a combination of a urea-formaldehyde resin and a polyisocyanate.

Without further elaboration, it is believed that one skilled in the art can, using the preceding description, utilize the present invention to its fullest extent. The following examples are presented to illustrate the invention and are not to be construed as limitations thereof.

EXAMPLE I

Various strength tests were run on sample pallets made in accordance with the invention using aspen roundwood flakes (average length of 1¾ inch and average thickness of 0.21 inch), 9 weight % urea-formaldehyde resin, and 1 weight % wax. The sample pallets had an average density of 39 pounds per cubic inch. A pressure of 300–350 psi, a temperature of 300°–325° F. and a press time of 4.5 to 7 minutes were used for molding.

Leg crushing tests were conducted on a Tinius Olson testing machine using 16 leg sections in a dry condition and 18 leg sections which had been soaked for 24 hours and then dried to a constant weight at 15% relative humidity and 70° F. The average crushing strength to a maximum load was 3548 pounds for the first group and 2727 pounds for the second group. On the basis of these test results, a 9-leg pallet theoretically can support a maximum of 24,543 pounds after being soaked and redried.

Deck strength was determined by testing 3 inch × 14 inch specimens cut from the decks of sample pallets. The average modulus of rupture was 2435 pounds per square inch. Other samples soaked for 48 hours and tested when wet had an average modulus of rupture of 1000 pounds per square inch.

EXAMPLE II

Pallets having different size and shape legs were molded from a variety of wood flakes and binders. Leg sections from these pallets were tested for crushing strength. The pallet legs, conditioned at 50% relative humidity and 70° F., were loaded in compression perpendicular to the pallet deck surface with a load rate of 0.10 inches per minute to a maximum of ½ inch deflection. The results from these tests are summarized in Table I.

TABLE I

CRUSHING STRENGTHS OF PALLET LEGS

| | | Leg Configuration | | | | | Crushing Strength | |
|---|---|---|---|---|---|---|---|---|
| Wood Type | Binder | Depth, in. | Side Wall Slope, deg. | Opening Size, in. | Deck Thickness, in. | Avg. Density, lbs/ft | Load to Proportional Limit, lbs. | Max. Load at ½-inch Deflection, lbs. |
| Elm | Urea-formaldehyde | 3¼ | 56 | 6½ × 9½ | .613 | 48.9 | 4320 | 7160 |
| Aspen | Urea-formaldehyde | 3¼ | 56 | 6½ × 9½ | .497 | 46.5 | 3060 | 6200 |
| Aspen | Urea-formaldehyde | 3½ | 70 | 6 × 9 | .610 | 59.1 | 5040 | 6480 |
| Aspen | Urea-formaldehyde | 3½ | 75 | 5½ × 8 | .449 | — | 4080 | 5018 |
| Aspen | Polyisocyanate | 3½ | 75 | 5½ × 8 | .504 | — | 4500 | 7400 |

From these test results, it can be seen that all the leg sections far exceeded the minimum requirements of the Static Load Capacity Test of ASTM D-1185-73, i.e., a center leg of a 2000 pound capacity pallet must support 15% of a 9750 pound load or 1462 pounds.

From the foregoing description, one skilled in the art can easily ascertain the essential characteristics of the invention and, without departing from the spirit and scope thereof, can make various changes and modifications to adapt the invention to various usages and conditions.

We claim:

1. A pallet comprising a generally flat, rectangular deck member having a major plane and a flat upper surface; and a plurality of parallel rows of spaced, hollow leg members projecting integrally from said deck member, said leg members in each of said rows being laterally aligned with a said leg member in the adjacent row, each of said leg members having a bottom wall spaced from said deck member a sufficient distance to permit entry of fork lift tines beneath said deck member and opposed pairs of side walls integrally connecting said bottom wall with said deck member and inclining outwardly from said bottom wall toward said deck member;

said deck and leg members being molded as a one-piece unit from a layered mixture of a resinous particle board binder and flake-like wood particles having an average length of about 1¼ to about 6 inches, an average thickness of about 0.005 to about 0.075 inch, and an average width of about 3 inches or less and no greater than the average length, each layer of said wood particles forming at least said deck member lying substantially flat in a plane generally parallel to the major plane with said wood particles therein being randomly oriented.

2. A pallet according to claim 1 wherein said deck and leg members are molded from said wood particles by depositing a loosely-felted, layered mat of said mixture on one part of an open mold including two separable parts defining a mold chamber having the desired shape of said pallet, closing the mold and applying sufficient heat and pressure to said mat to compress it into substantially the desired shape and size of said pallet and to bond said wood particles together.

3. A pallet according to claim 1 wherein said side walls extend at an angle of about 78° or less relative to the major plane of said deck member.

4. A pallet according to claim 1 wherein the average thickness of said sidewalls is about 70–110% of the average thickness of said deck member.

5. A pallet according to claim 1 wherein the average thickness of said wood particles is about 0.015 to about 0.025 and the average length is about 2 to about 3 inches.

6. A pallet according to claim 5 wherein the average width of said wood particles is about 1/16 inch to about 3 inches.

7. A pallet according to claim 1 wherein said molded deck and leg members contain about 2 to about 15 weight % of said binder.

8. A pallet according to claim 7 wherein said binder includes an organic polyisocyanate having at least two active isocyanate groups per molecule.

* * * * *